US005080163A

United States Patent [19]

Blin

[11] Patent Number: 5,080,163

[45] Date of Patent: Jan. 14, 1992

[54] DEVICE FOR SEALING IN THE CONTINUOUS CASTING OF MOLTEN METAL BETWEEN TWO PARALLEL ROLLS

[75] Inventor: Philippe Blin, Lorry-les-Metz, France

[73] Assignee: Usinor Sacilor, Puteaux, France

[21] Appl. No.: 575,949

[22] Filed: Aug. 31, 1990

[30] Foreign Application Priority Data

Sep. 1, 1989 [FR] France ..... 89 11501

[51] Int. Cl.[5] ..... B22D 11/06

[52] U.S. Cl. ..... 164/432; 164/428

[58] Field of Search ..... 164/480, 481, 428, 432

[56] References Cited

U.S. PATENT DOCUMENTS 4,754,802 7/1988 Yamauchi et al. .

FOREIGN PATENT DOCUMENTS 59-191549 10/1984 Japan .
61-49755 3/1986 Japan .
61-74757 4/1986 Japan .
1-87043 3/1989 Japan .
1186247 7/1989 Japan ..... 164/428

*Primary Examiner*—Richard K. Seidel
*Assistant Examiner*—Edward A. Brown
*Attorney, Agent, or Firm*—Fay, Sharpe, Beall, Fagan, Minnich & McKee

[57] ABSTRACT

This device comprises plates held against front faces (1*a*, 2*a*) of the rolls (1, 2) in order to close the ends of a casting space (3) delimited by the rolls; each front face (1*a*, 2*a*) of a roll is equipped with a flexible endless band (5, 5') bearing, on the one hand, on the roll at the junction of its front face (1*a*) and its cylindrical surface (1*b*) and, on the other hand, on the opposite face of the associated closing plate (4), in order to ensure the seal between the latter and the front faces of the rolls.

7 Claims, 2 Drawing Sheets

FIG. 1
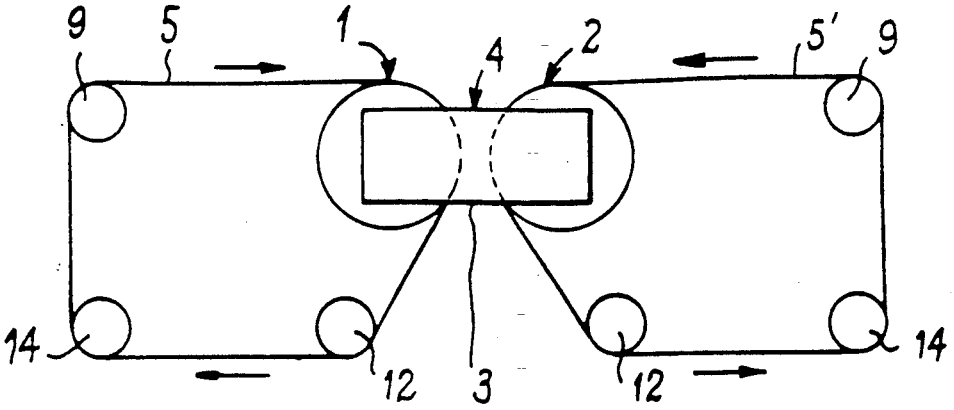
FIG. 2
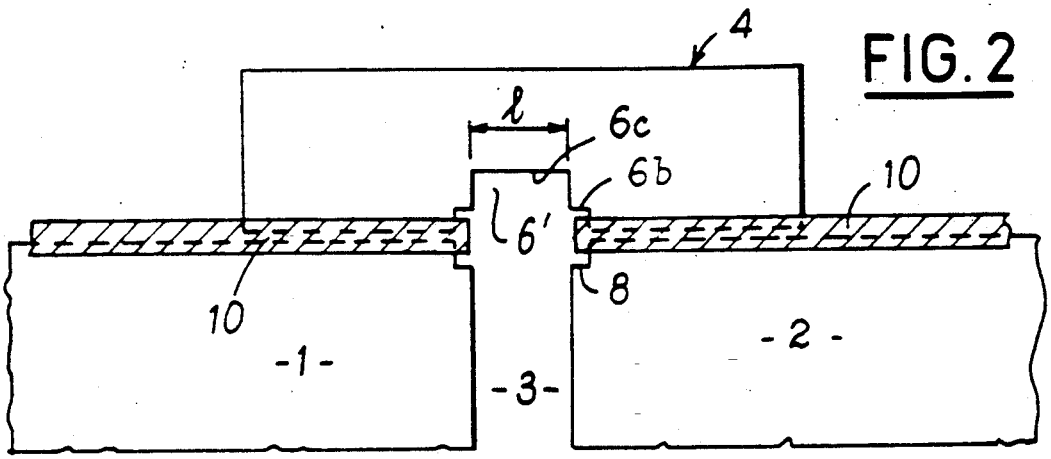
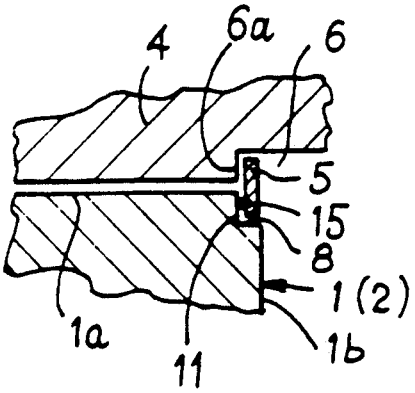
FIG. 3

DEVICE FOR SEALING IN THE CONTINUOUS CASTING OF MOLTEN METAL BETWEEN TWO PARALLEL ROLLS

The present invention relates to a device for the continuous casting of molten metal, for example steel, between two parallel rolls, of the type comprising plates held against the front faces of the rolls in order to close the ends of the casting space delimited by the rolls.

It is known that, in this type of device, there is a risk of infiltrations at the joint between the closing plates, currently called "lateral faces", and the rolls, particularly when using "wetting" refractory such as oxides. In fact, these infiltrations of molten metal can cause the blockage of the movable parts (rolls) with respect to the fixed lateral faces.

The invention. thus aims to produce a device equipped with means which make it possible to prevent these infiltrations of molten metal in the joint between the lateral faces and the front faces of the rolls.

According to the invention, each front face of a roll is equipped with an endless flexible band bearing, on the one hand, on a cylindrical end surface of the roll at the junction with its front face and, on the other hand, on a curved surface of the associated closing plate, this curved surface being in the extension of the said cylindrical surface of the roll, in order to ensure the seal between the closing plate and the front faces of the rolls.

In order to permit installation of these flexible bands, a clearance, referred to as a "negative insert", is provided in the face of each closing plate opposite the casting space between the rolls which is thus extended by this clearance. The clearance thus permits the creation of the said curved surfaces of the closing plate.

Each endless band may be guided in a groove provided on the roll at the junction of its front face and its cylindrical surface and/or in a second groove formed in the said curved surface of the closing plate.

The endless bands may be driven either by a motor or by the rolls, for example by means of teeth formed on the latter.

Other features and advantages of the invention will become apparent during the following description which is given with reference to the appended drawings which illustrate an embodiment thereof by way of non-limiting example.

FIG. 1 is a diagrammatic front view in elevation of an embodiment of the device for the continuous casting of molten metal equipped with endless bands according to the invention.

FIG. 2 is a partial plan view on an enlarged scale of one end of the continuous-casting device in FIG. 1, showing a first possible arrangement of two endless bands and of a corresponding closing plate.

FIG. 3 is a detail view in longitudinal section of a second embodiment of the front face of a roll and of the endless band with which it is equipped.

Figure 4:
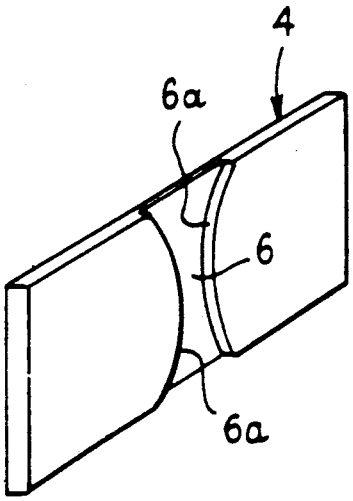
FIG. 4 is a perspective view of the closing plate corresponding to FIG. 3.

The device shown in FIGS. 1 to 5 is intended for the continuous casting of molten metal between two parallel rolls 1 and 2, delimiting between them a space 3 for the casting of flat products. This space 3 is closed by plates 4 held so as to bear against the front faces 1*a*, 2*a* of the rolls 1, 2 via means which are known per se and are not shown.

Each front face 1*a*, 2*a* is equipped with an endless flexible band 5, 5' respectively, bearing, on the one hand, on the corresponding roll 1, 2 at the junction of its front face 1*a*, 2*a* and of its cylindrical surface 1*b*, 2*b* and, on the other hand, on the opposite face of the associated closing plate 4. In order that the two bands 5, 5' associated with a plate 4 can effectively cover the joint 10 between the rolls 1, 2 and the plate 4, a clearance 6, whose width 1 in its central zone is equal to the width of the casting space 3, is formed in the face of the plate 4 which is turned towards the rolls 1, 2. The convex edges 6*a* of the clearance 6, referred to as a "negative insert", have a radius of curvature which is equal to that of the rolls 1 and 2 and are placed opposite the edges of the latter.

The width of the bands 5 and 5' is determined such that they cover the joint 10, bearing on either side of the latter on corresponding surfaces 6*a*, of the plate 4, and 11, of the ends of the rolls 1, 2. The surfaces 11 form the bases of cylindrical clearances 8 made in the ends of the rolls 1 and 2 opposite the surfaces 6*a*.

In the embodiment of FIG. 2, which is an alternative embodiment of FIGS. 3 and 4, the surfaces 6*a* form the bases of clearances 6*b* of the plate 4, beyond which is provided an additional clearance 6', in a direction parallel to the axes of the rolls 1, 2.

This clearance 6' can act, for example, as a support for a refractory lining and its base 6*c* can be inclined on a vertical plane.

The bands 5, 5' pass over return and tension rollers 9, 12, 14 (FIG. 1), the lower rollers 12 judiciously being arranged so that the bands 5, 5' do not remain in contact with the cast metal below the plates 4. The bands 5, 5' may be driven either by a motor (not shown) at the same speed of rotation as the cylinders 1 and 2, or by the latter by means, for example, of teeth 15 formed on the rolls (FIG. 3).

Figure 5:
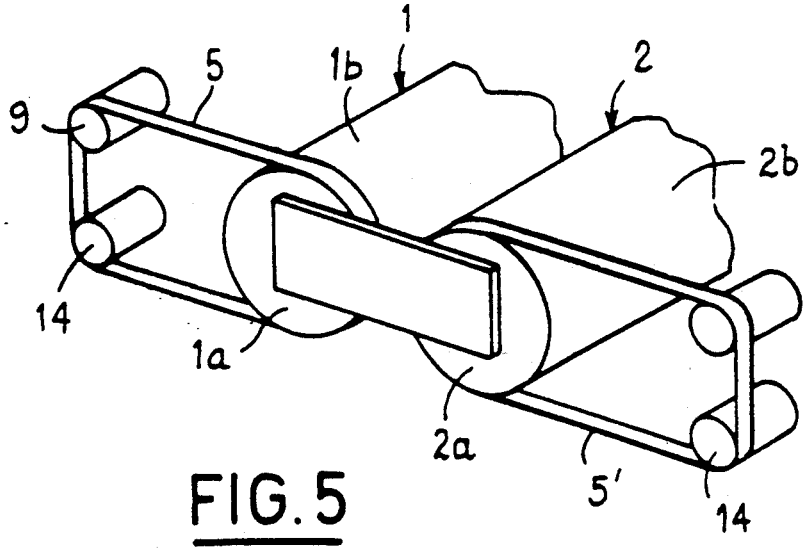
FIG. 5 is a partial diagrammatic view in perspective of an alternative embodiment of the device in which the endless bands coil over half the circumference of the rolls.

The embodiment of FIG. 5 comprises only the return rollers 9, 14 such that the endless bands 5, 5' coil over half the circumference of the surfaces 11 of the rolls 1, 2, the bearing surfaces 6*a* naturally having the same radius of curvature as the rolls.

Means are advantageously provided for cooling the endless bands 5, 5', for example nozzles (not shown) for spraying water placed on each side of the device.

When the grooves 8 and those 6*b* of the edges 6*a* are produced simultaneously, an entirely plane junction is obtained at the level of the joint 10.

The invention thus implements sealing bands 5, 5', with a width of a few millimeters, at the intersection between the rolls 1, 2 and the negative inserts 6, which run at the same speed as the rolls.

This results in the virtual elimination of any risk of infiltration of molten metal into the joint 10.

According to an alternative embodiment, the setbacks 8 are dispensed with and the bands 5, 5' bear directly on the cylindrical surfaces 1*b*, 2*b*.

I claim:

1. Device for the continous casting of molten metal between two parallel rolls (1, 2), comprising closing plates (4) held against front faces (1*a*, 2*a*) of the rolls (1, 2) in order to close the ends of a casting space (3) delimited by the rolls, characterized in that each front face (1*a*, 2*a*) of a roll is equipped with an endless flexible band (5, 5') bearing, on the one hand, on a cylindrical end surface (11) of the roll at the junction with its front face (1*a*) and, on the other hand, on a curved surface (6*a*) of the associated closing plate (4), this curved surface being in an extension of said cylindrical surface of the roll, in order to ensure the seal between the closing plate and the front faces of the rolls.

2. Device according to claim 1, characterized in that each endless band (5, 5') is guided in a groove (8) provided on the roll (1, 2) at the junction of its front face (1*a*) and its cylindrical surface (1*b*) and/or in a second groove (6*b*) formed on a circular bearing edge (6*a*) of a clearance (6) made in the closing plate (4).

3. Device according to claim 2, characterized in that the endless bands (5, 5') pass over return and tension rollers (9, 12, 14).

4. Device according to claim 1, characterized in that the endless bands (5, 5') are driven by the rolls (1, 2) for example by means of teeth (15) formed on the latter.

5. Device according to claim 1, characterized in that means are provided in order to cool the endless bands, by means of spraying water.

6. Device according to claim 1, characterized in that each endless band (5, 5') is guided in a groove (8) provided on the roll (1, 2) at the junction of its front face (1*a*) and its cylindrical surface (1*b*) or in a second groove (6*b*) formed on a circular bearing edge (6*a*) of a clearance (6) made in the closing plate (4).

7. Device according to claim 1, characterized in that the endless bands (5, 5') are driven by the rolls (1, 2) by means of a motor.

* * * * *